United States Patent [19]

King et al.

[11] Patent Number: 4,936,477

[45] Date of Patent: Jun. 26, 1990

[54] CARGO CONTAINER

[76] Inventors: Edgar King, 310, 1363 Clyde Ave.; Ronald Brasier, 203, 1363 Clyde Ave., both of West Vancouver, B.C., Canada, V7T 2W9

[21] Appl. No.: 400,710

[22] Filed: Aug. 30, 1989

[51] Int. Cl.[5] ..... B65D 6/28; F16B 7/00

[52] U.S. Cl. ..... 220/1.5; 220/4 F; 220/72.1; 220/84; 52/397

[58] Field of Search ..... 220/4 F, 4 R, 1.5, 72.1, 220/80, 84; 52/281, 282, 397

[56] References Cited

U.S. PATENT DOCUMENTS

| | | | |
|---|---|---|---|
| 2,956,705 | 10/1960 | Clingman | 220/80 |
| 3,712,504 | 1/1973 | Petersen | 220/84 |
| 3,784,043 | 1/1974 | Presnick | 220/84 X |
| 3,955,702 | 5/1976 | Lundy | 220/4 F |
| 3,972,437 | 8/1976 | Lovich et al. | 220/4 R |
| 3,989,157 | 11/1976 | Veenema | 220/84 |
| 4,558,797 | 12/1985 | Mitchell | 220/4 F |
| 4,731,973 | 3/1988 | Stenemann | 52/282 X |
| 4,770,312 | 9/1988 | O et al. | 220/4 F |

*Primary Examiner*—Paul T. Sewell
*Assistant Examiner*—Jacob K. Ackun, Jr.
*Attorney, Agent, or Firm*—Shlesinger & Myers

[57] ABSTRACT

A container which includes a plurality of elongated frame members each having an elongated channel and an elongated recess therein and a plurality of coupling members removably engagable with ends of the frame members. A plurality of panels is removably engagable with the elongated channels in the frame members and each of the panels has an elongated recess around a perimeter thereof which, together with the elongated recess in each of the frame members, forms an elongated slot. A lock element is removably insertable into the slots formed by the panel recesses and frame member recesses, when the panels are in engagement with the channels, to lock the frame members, panels and coupling members into a substantially rigid assembly.

19 Claims, 7 Drawing Sheets

CARGO CONTAINER

BACKGROUND

This application relates to an improved cargo container adapted for use for either air or ground transport having components which are simple to assemble and disassemble and a construction which is tolerant of flexing and deformation of the panels and frame.

The use of transparent panels is disclosed by U.S. Pat. No. 4,833,771 issued May 30, 1989 to Dunwoodie. These panels are held by inner and outer corner moldings and therefore require custom fabrication of the edges of the panels of accommodate the shape of the inner and outer molds. Such processing of the panel edges necessarily introduces stress cracks which can lead to failure during use. Nuts and bolts are used to attach the inner and outer corner moldings together over the panel edges.

A shipping container capable of being assembled without tools, i.e. without nuts and bolts or other like fasteners, is disclosed in U.S. Pat. No. 3,517,849 issued to Presnick. Presnick uses extruded frame members with elongated slots to receive the edges of a rigid panel and corner members with legs to fit into the hollow ends of the extruded frame elements. The frame elements matingly couple to each other so that a panel enclosed by frame elements and corner members interlocks with a panel and surrounding frame element and corner members corresponding to each one of the elongated edges of the panel. The Presnick assembly is not water tight at the edges proximate the corner pieces since it is not cemented to the corner pieces. Moreover, the latter assembly is not highly deformation tolerant as deformation puts a strain on the edge joints and the rigid panels themselves. Finally the panels of Prenick can not be removed without first disassembling at least in part the frame structure.

Italian patent No. 623,118 issued July 7,1961 to J. Langham Thompson Group Limited discloses a knockdown container assembly with corner pieces having legs dimensioned to fit into the ends of extruded frame elements and planels which are attached by screws to the extruded frame elements. The corner pieces consist of an outside rounded piece with a bolt and the inner corner piece with a bolt hole and a nut threaded onto the bolt to hold the inner and outer corner piece together.

The utilization of rigid panels with edges either glued to the frame elements or fastened thereto with screws makes the known cargo containers susceptible to fracture of the panels or failure of the edge joint on being deformed in response to an applied load. Since it is common practice apply large loads to the inside walls during filling of a container which can cause deformation of the container and subsequent failure, such assemblies tend to have a relatively limited life when used as airline, trcuk or ship containers.

Accordingly, it is an object of the present invention to provide an improved cargo container. It is a further object of the invention to provide a cargo container that can be easily assembled and disassembled. It is yet a further object of the invention to provide such a container that is better able to withstand deformation than hitherto known containers. Yet another object of the invention is to provide a container which is substantially water tight.

STATEMENT OF THE INVENTION

Advantageously, the channels are located on the interior of the container to enhance security. Such an assembly avoids the need for using fasteners such as nuts and bolts which are time consuming and provides an easily assembled or disassembled structure.

Preferably, however, resilient means are used for removably affixing the panels to the frame members and coupling members around the perimeter of the openings. The use of a resilient means for affixing the panels to the frame and coupling members not only avoids the need for separate fasteners such as nuts and bolts but also introduces a tolerance to bending or flexing of the structure not otherwise available.

Preferably, the resilient means is a resilient strip of material captured between an elongated surface portion of the frame element and an a elongated surface portion of a edge of the panel.

The panel may include a flexible sheet having affixed around its edges to a rigid panel frame. Use of a flexible sheet rather than a rigid sheet avoids the susceptibility of fracture of the panels due to deformation of the container and makes the structure more deformation tolerant. Moreover, no drilling of the panel edges is required so that the panel is not compromised or stressed by such treatment.

The resilient strip is preferably located on the interior of the container so that loads applied internally of the container merely tend to tighten the strip in position rather than dislodge it and so that the strip is not exposed to external uncontrolled contact. The interior location also provides for greater security against unauthorized access to the contents of the container.

The frame members may be hollow extruded aluminum with a pair of elongated rounded recesses for receiving rounded strips or O-Rings and having a channel with a sidewall slightly sloped back to form an angle with the base of the channel of slightly less than 90 degrees. The panel frames have elongated projections insertable into corresponding channels of the panel frame with a sidewall abutting and parallel to the sidewall of the frame channel. The O-Ring presses the sidewall of the panel frame against the sidewall of the frame member. Deformation of the panels so that thay move outwardly causes the panel projection to simply rotate about a line on the frame member channel and at the same time to merely compress the O-Ring so that there is no prohibition to slight movement caused by frame member to panel frame material contact.

BRIEF DESCRIPTION OF THE DRAWINGS

The novel features believed characteristic of the invention are set forth in the appended claims. The invention itself, however, as well as other features and advantages thereof, will be best understood by reference to the detailed description which follows, read in conjunction with the accompanying drawings, wherein:

DETAILED DESCRIPTION WITH REFERENCE TO THE DRAWINGS

Figure 1:
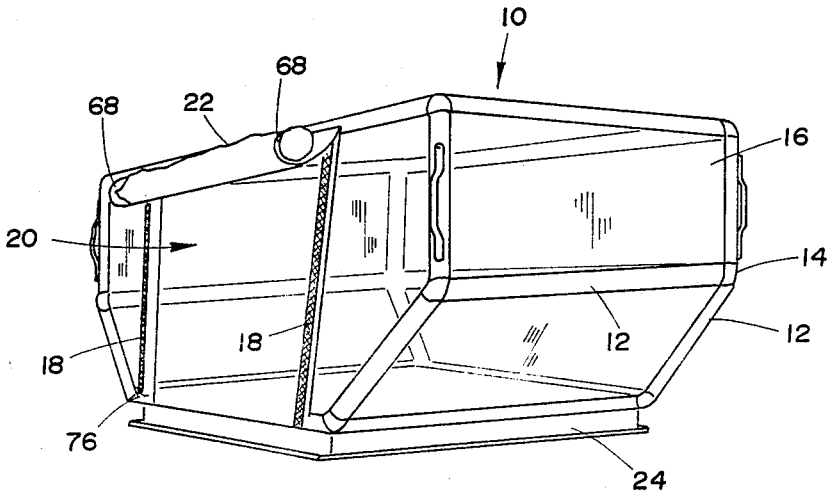
FIG. 1 is a perspective view of the container.

Referring to FIG. 1 there is shown a cargo container 10 made up of a plurality of frame members 12 coupled to adjacent frame members 12 by couplers 14. In each open area defined by coupled frame members and couplers 14 there is attached a transparent rectangular panel 16. On one side of the container 10 there is an opening 20 and a roll-up door 22 releasably attachable to fibre attachment strips sold under the trandemark Velcro* along either side of the opening 22. The entire top structure of the container 10 is removably fastenable by means of nuts and bolts to a base 24.

Figure 2:
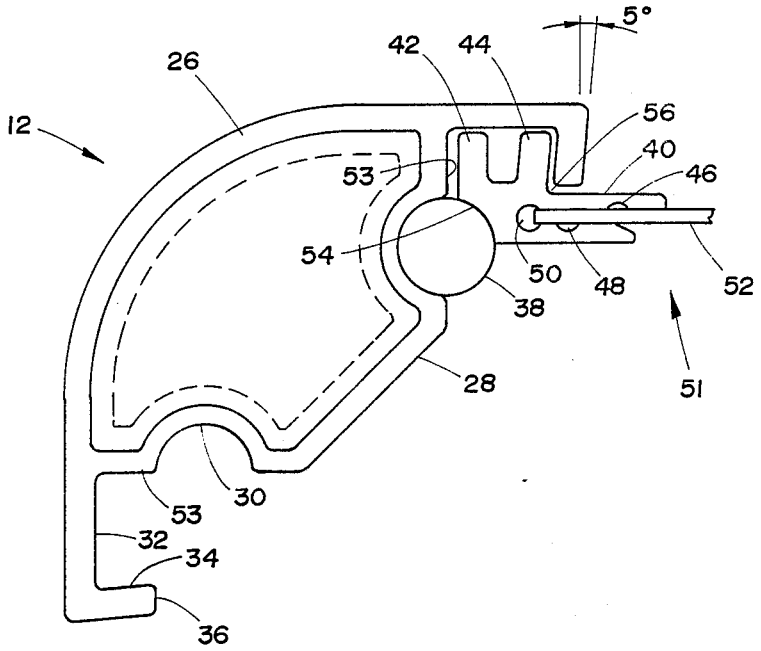
FIG. 2 is an end view of a frame member with a panel edge portion and panel frame in cross-section shown held in place by an O-Ring.

The cross section of a frame membert 12 is shown in FIG. 2 as being a hollow extruded aluminum strcuture. The member 12 is for use at the intersection of two panels 16 intersecting at right angles. In this case arc section 26 describes a quarter circle whereas for other angles of intersection the arc section would describe a different sector of a circle. At either end of arc section 26 there is a rounded elongated recess 30 joining an end of arc section 26 to a diagonal section 28. Also at each of arc section 26 there is an extension 32 tangent to arc section 26 terminating in a substantially orthogonal lip 36 having an inner wall 34 sloped back slightly from 90 degrees to arc section 26 by 1/32 inches in ⅜ inches distance or about 5 degrees.

Each panel 51, only a portion of which is shown in FIG. 2, is a transparent flexible plastic sheet 52 glued around its perimeter to a rigid perimeter edging 40. Edging 40 has enlargements 46, 48 and 50 which serve as glue channels and a pair of spaced apart lips 42 and 44 projecting substantially at right angles to the plane of panel 52. Lip 44, however, is sloped outwardly about 5 degrees to match the slope of the inner wall 34 of lip 36. The total width of lips 42 and 44 is chosen to be less than the width of extension 32 so that frame 40 can rotate slightly about a contact point 56 with lip 36 in a counter-clockwise direction as viwed in FIG. 2 without contacting wall 53. Edging 40 also has a rounded elongated recess 54 so that in combination with recess 30 of frame member 12 there is provided a circular O-Ring slot subtending about 270 degrees for a resilient O-Ring 38. With O-Ring 38 in place edging 40 is held within a channel 31 formed by extension 32 and walls 53 and 34 with lip 44 abutting inner wall 34.

An outwardly directed load applied to pannel 51 results in outward movement of sheet 52 and a torque applied to perimeter frame 40 about an axis coinciding with line 56. Lips 42 and 44 move toward wall 53 and compress further O-Ring 54 which resists the deformation of frame 40.

Figure 3:
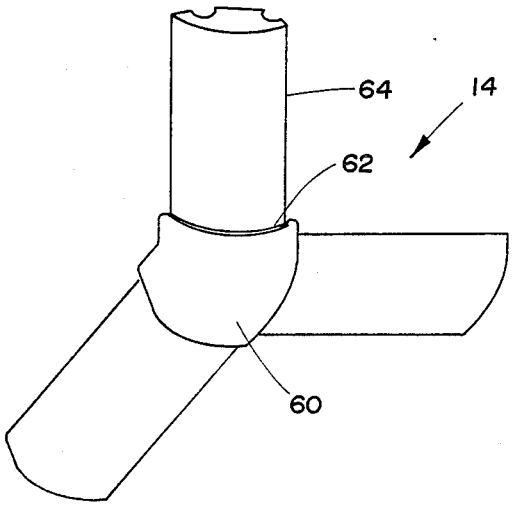
FIG. 3 is a perspective view of an exterior surface of a frame member coupler.
Figure 4:
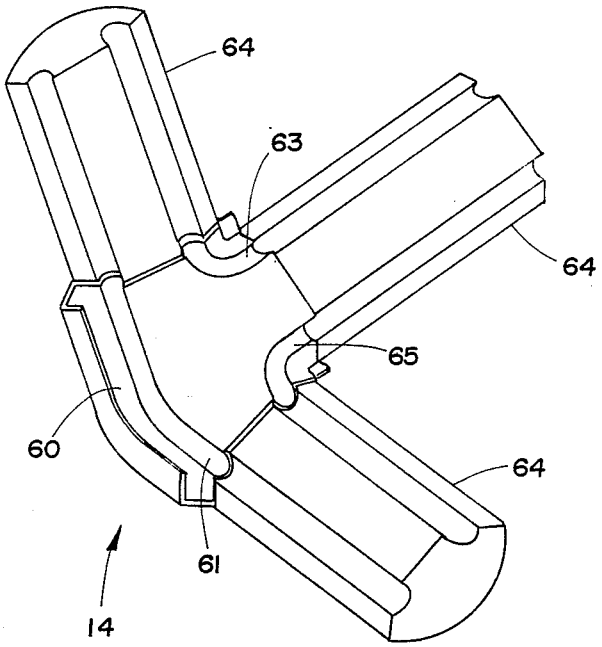
FIG. 4 is a perspective view of an interior surface of a frame member coupler.

A coupler 14 for coupling together frame members 12 is shown in FIG. 3 as including an elarged section 60 integral with three different legs 64 each having a cross-section designed to fit inside an associated frame member 12 as shown in the dotted outline of FIG. 2 with a shoulder 62 between the two abutting an end of each frame member 12. As shown in FIG. 4 each coupler has grooves 61, 63 and 65 which align with corresponding grooves 30 in the frame members 12. The couplers 14 are made of metal or rigid plastic such as polycarbonate. The latter material will return to its original shape after deformation.

Figure 5:
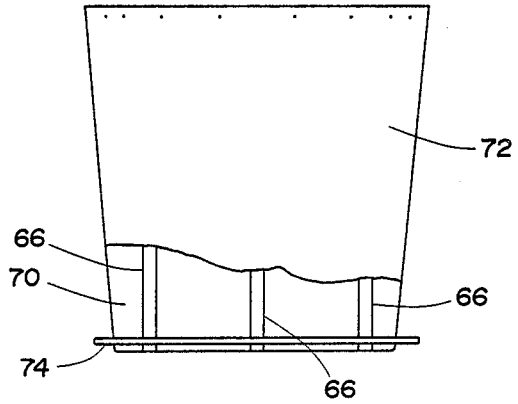
FIG. 5 is a perspective view of the door covering with the outer lining partially broken away and a corner of the inner lining also broken away.

Door opening 20 is covered by a roll-up door 22 shown in more detail in FIG. 5. Door 22 is made of 2 sections 70 and 72 of flexible sheet material sewn together to enclose springs 66 along each side and the center. Springs 66 are made of stainless steel tempered to a coiled up equilibrium position so that when enclosed they tend to cause cover 22 to roll up into a coiled position. A pair of fibre attachment strips 68 fastened to the interior of door 22 align with corresponding strips 18 along the sides of opening 20 and attach to the latter to hold the door 22 in a closed position until the corresponding fibre attachment strips 18 and 68 are released from each other. A crossbar 74 located proximate a bottom end of door 22 fits into crossbar sockets 76 on either side of opening 20 on container 10 when the door is unrolled.

Figure 6:
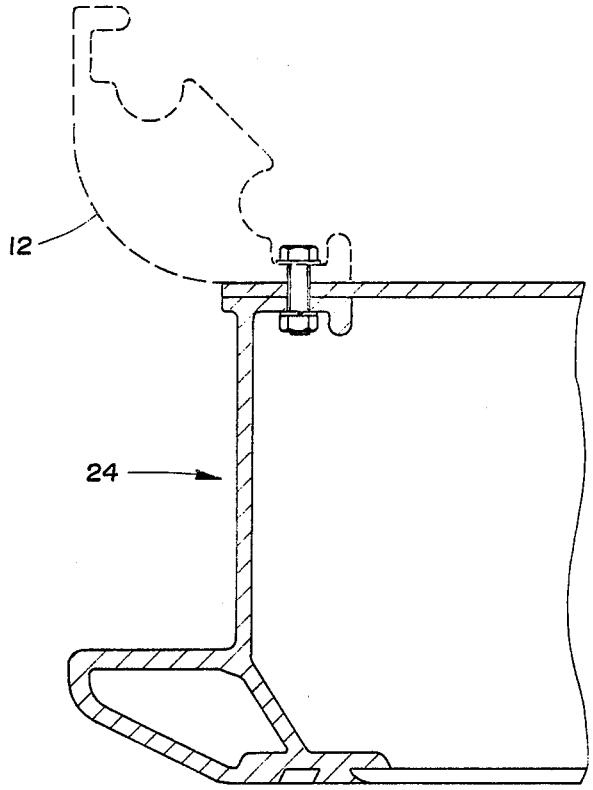
FIG. 6 is a cross-sectional view of the base and frame member connection thereto.

As shown in FIG. 6 , the bottom extruded frame members 12 are bolted to a base 24 to complete the structure of the container 10. The entire container 10 with the exception of the base 24 and door suspension attachment is assembled without fasteners such as nuts and bolts. Assembly of the container proceeds from the base and progresses upwardly. The bottom layer of frame members are coupled together with couplers 14 and then upwardly directed frame members are slid onto corresponding legs 64. Once all of the frame members are assembled the bottom layer is bolted onto base 24. Following bolting of the bottom layer to base 24, the transparent panels 51 are set in place from the interior of the container 10 and resilient O-Rings are inserted into O-Ring grooves 30 and corresponding ones of 61, 63 and 65 on couplers 14. The top of the door is fastened to the top of the container 10 to complete the assembly. The entire structure can be rapidly disassembled for shipment and then reassembled once it reaches its destination.

Figure 7:
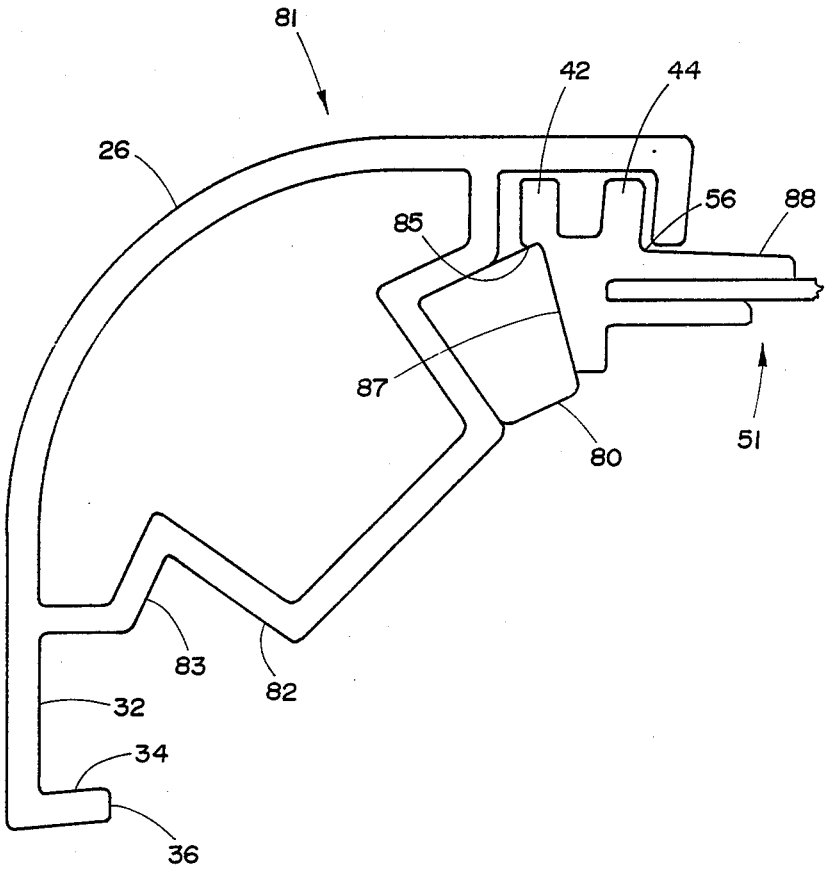
FIG. 7 is a cross-sectional view of an alternative embodiment of the frame member.

An alternative variant of the frame members and couplers is shown in cross section in FIG. 7. In this case the O-Ring 80 is trapezoidal as is the groove formed by walls 82 and 83 of frame member 81 and surfaces 85 and 87 of perimeter frame 88. Other similar variants are obviously possible.

Clearly various other container shapes than that of FIG. 1 are possible to conform to the vehicle into which the container is loaded.

Obviously, metal panels can be substituted for the flexible plastic ones although with some loss of deformation tolerance.

The resilient O-Ring one strip 38 can be replaced by a rigid or semi-rigid bar or tube inserted into the ends of each extruded frame member with one of the two couplers removed. Although reduced tolerance to deformation is achieved the assembly is still simple to assemble and disassemble when used in this way.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall with the true scope of the invention.

We claim:

1. A container, comprising:

(a) a plurality of elongated frame members each having an elongated channel and an elongated recess therein;

(b) a plurality of coupling members removably engagable with ends of said frame members;

(c) a plurality of panels removably engagable with the elongated channels in said frame members and each of said panels having an elongated recess around a perimeter thereof which, together with the elongated recess in each of said frame members, forms an elongated slot; and (d) locking means removably insertable into the slots formed by the panel recesses and frame member recesses, when said panels are in engagement with the channels, to lock said frame members, panels and coupling members into a substantially rigid assembly.

2. A container according to claim 1, wherein the channels and slots are formed in the interior of said container.

3. A container according to claim 1, wherein said locking means is a resilient elongated strip and said frame members are rigid.

4. A cargo container, comprising:

(a) a plurality of elongated frame members each having two elongated channels and an elongated recess adjacent to each of the channels;

(b) a plurality of coupling members removably engagable with ends of said frame members;

(c) a plurality of panels removably engagable with the channels in coupled ones of said frame members and each panel having an elongated recess around the perimeter thereof such that, when said each panel is engaged with corresponding channels in said frame members, the panel recess in combination with corresponding recesses of said frame members form an elongated slot around the perimeter of said each panel;

(d) resilient means insertable into each of said slots for removably affixing each of said panels to said frame members such that edges of said panels may reversibly move slightly against only the compression resistance of a corresponding resilient strip in response to loads applied to said panels from within the container;

and wherein loads applied from within the container to the panels are transmitted to the perimeters of the panels and act to locate them more firmly in the channels.

5. A container according to claim 4, wherein said resilient means is a resilient strip of material captured between an elongated recess of said frame element and an elongated recess in an edge of said panel, and side walls defining the channels are substantially transverse to a plane of said panels.

6. A container according to claim 5, wherein said panel includes a flexible sheet with a rigid edging affixed around its perimeter edges.

7. A container according to claim 5, wherein said strip is on a side of said frame members interior of said container.

8. A container according to claim 6, wherein said edging and said frame member have opposed, abutting, retaining surface portions substantially transverse to a plane of said panels which permit limited rotation of said edging relative to said frame member against a resisting force provided by compression of said resilient strip without having to significantly bend of flex either said edging or said frame member.

9. A container according to claim 6, wherein said frame member has an elongated channel on either side thereof and an elongated recess adjacent each of said channels and said edging includes a lip projecting substantially perpendicular from a plane of said flexible sheet and insertable into a corresponding one of the channels and said edging having an elongated recess which, in combination with a corresponding one of said frame member elongated recesses, forms an elongated slot when said edging lip is inserted into the corresponding channel.

10. A container according to claim 9, wherein said projecting lip of said panel is sufficiently narrower than the channel such that said edging can rotate about an outer edge of the lip of said frame member, which defines in part said channel, against compression resistance of an elongated resilient strip inserted into the slot.

11. A container according to claim 9, wherein said slot is partially circular in cross-section for receiving a resilient strip of circular cross-section.

12. A container according to claim 4, wherein said frame members are extruded aluminum.

13. A container according to claim 4, wherein said pannels are transparent plastic.

14. A cargo container, comprising:

(a) a plurality of hollow elongated extruded frame members each having a pair of elongated channels and an elongated recess adjacent each channel;

(b) a plurality of coupling members having bosses of a cross-section to be matingly slidably insertable into ends of said frame members;

(c) a plurality of panels each panel having a lip projecting substantially perpendicular to a plane of said panel, said panel lip insertable into the channels in coupled ones of said frame members each of said panels having an elongated recess around its perimeter which in combination with corresponding ones of elongated recesses in said frame member form an elongated slot; and (d) a resilient elongated strip insertable into the elongated slot of a corresponding one of said pannels and associated frame members so as to retain said panel and associated frame members in a substantially rigid assembly.

15. A container according to claim 14, wherein said panel includes a flexible sheet with a rigid edging affixed around its perimeter.

16. A container according to claim 14, wherein said resilient strip is an O-Ring and is on a side of said frame members interior of said container.

17. A container according to claim 15, wherein said edging and said frame member have opposed abutting retaining surface portions which permit limited rotation of said edging relative to said frame member against a resisting force provided by compression of said resilient strip without having to significantly bend or flex either said edging or said frame member.

18. A container according to claim 14, wherin each of said frame members has a channel on either side thereof and said elongated recesses are each adjacent an associated one of said channels in said frame members and said edging includes a lip projecting substantially perpendicular from a plane of said flexible sheet insertable into a corresponding channel, said edging having an elongated recess such that when said lip is inserted into corresponding ones of the channels, in combination with the frame member recesses forms a slot having a substantially continuous slot surface and wherein said panel includes a flexible sheet to the perimeter of which is glued said rigid edging.

19. A container according to claim 18, wherein said projecting lip is sufficiently narrower than said channel such that said edging can rotate about an outer edge of an outer wall of said channel against compression resistance of a resilient strip inserted into the elongated slot.

* * * * *